US005276448A

United States Patent [19]

Naito et al.

[11] Patent Number: 5,276,448

[45] Date of Patent: Jan. 4, 1994

[54] BROAD-BAND WAVE ABSORBER

[76] Inventors: Yoshiyuki Naito, 9-29, Tsukimino 8-Chome, Yamato-shi, Kanagawa-ken, Japan; Michiharu Takahashi, 390-190, Takatsu, Yachiyo-shi, Chiba-ken, Japan

[21] Appl. No.: 875,200

[22] Filed: Apr. 24, 1992

Related U.S. Application Data

[63] Continuation of Ser. No. 643,772, Jan. 22, 1991, abandoned.

[30] Foreign Application Priority Data

| | | | |
|---|---|---|---|
| Jan. 25, 1990 | [JP] | Japan | 2-15798 |
| Feb. 2, 1990 | [JP] | Japan | 2-23818 |
| Jun. 8, 1990 | [JP] | Japan | 2-150690 |
| Jun. 20, 1990 | [JP] | Japan | 2-162403 |

[51] Int. Cl.[5] ..... H01Q 17/00

[52] U.S. Cl. ..... 342/4; 342/1

[58] Field of Search ..... 342/4, 1

[56] References Cited

U.S. PATENT DOCUMENTS

| | | | |
|---|---|---|---|
| 3,124,798 | 3/1964 | Zinke | 342/4 X |
| 4,023,174 | 5/1977 | Wright | 342/1 |
| 4,118,704 | 10/1978 | Ishino et al. | 342/1 |
| 4,973,963 | 11/1990 | Kurosawa et al. | 342/4 |

FOREIGN PATENT DOCUMENTS

| | | | |
|---|---|---|---|
| 776158 | 6/1957 | United Kingdom | 392/4 |

OTHER PUBLICATIONS

Walther, K., "Air Force Technical Report," Absorption and Transmission of Electromagnetic Waves, Phase F, Göttingen, Jul. 1958 pp. 48–54.

*Primary Examiner*—Gilberto Barrón, Jr.
*Attorney, Agent, or Firm*—Ladas & Parry

[57] ABSTRACT

The present invention relates to a broad-band wave absorber wherein beams (3) formed of a ferrite magnetic material are placed at an optimal spacing and are aligned in a lattice form in longitudinal and lateral directions on a conductive plate (2). A magnetic substance of a specific thickness $t_m$ is formed into cylindrical blocks of a height d (where $d \geqq t_m$) wherein an end surface thereof is polygonal, and the cylindrical blocks are provided with a radio-wave reflecting surface aligned in such a manner that this surface is perpendicular to the axial direction of the blocks, and the end surface of the blocks is approximately perpendicular to a direction from which radio waves are incident. The ferrite magnetic substance could also be formed into rectangular prisms of thickness $2t_m$, height d, and length in the longitudinal direction thereof L, with the prisms aligned at a spacing b on a radio-wave reflecting surface, the direction of the height dimension of the prisms being approximately parallel to a radiowave incidence direction, and the surfaces thereof of the dimensions $2t_m$ and L being perpendicular to the radiowave incidence direction, forming a plane parallel to a magnetic field direction of incident radio waves and the dimension L, wherein the following relationships hold:

$$L \geqq d \geqq 2t_m$$

$$20t_m \geqq b \geqq 2t_m$$

13 Claims, 8 Drawing Sheets

BROAD-BAND WAVE ABSORBER

This is a continuation of copending application(s) Ser. No. 07/643,772 filed on Jan. 22, 1991 now abandoned.

BACKGROUND OF THE INVENTION

1. Field of Application

The present invention relates to a wave absorber constructed using a ferrite magnetic material, and, in particular, to a broad-band wave absorber in which ferrite blocks are arranged at a specific spacing on a conductive plate.

2. Description of the Prior Art

Much research has been performed on conventional wave absorbers that use ferrite, so much so that their capabilities are becoming well-known.

The construction of the wave absorber that has become a conventional standard is such that ferrite tiles (plates) are arranged on a conductive plate, as shown in FIG. 17.

For unidirectional-polarization use, a variation has been proposed (in U.S. Pat. No. 4,118,704) in which some of the ferrite plates are removed in a regular pattern in an electric field direction to leave portions where the conductive plate is exposed (called vacant portions), as shown in FIG. 18.

In general, if such vacant portions are provided, characteristics the same as those of the structure of FIG. 17 can be obtained by making the thickness of the ferrite in the ferrite parts greater than that of the ferrite of FIG. 17, but the bandwidth characteristics cannot be expected to be improved thereby. (Problem to be Solved by the Present Invention)

To widen the bandwidth, it is needed to provide some other technologies.

SUMMARY OF THE INVENTION

An object of the present invention is to provide a novel wave absorber having an improved characteristic of handwidth. The present invention was designed while taking the above points into consideration, with the aim of providing a broadband wave absorber that has a much broader bandwidth than a conventional absorber, that can be used in the VHF, UHF, and microwave bands, and that has excellent characteristics such that it can not only be used as an absorber with respect to waves polarized in the horizontal and vertical directions, it can also be used as a wave absorber for unidirectional-polarization use.

In order to satisfy the above aim, the present invention provides a broad-band wave absorber wherein beams formed of a ferrite magnetic material are placed at an optimal spacing and are aligned in a lattice form in longitudinal and lateral directions on a conductive plate. A magnetic material of a specific thickness $t_m$ is formed into cylindrical blocks of a height d (where $d \geqq t_m$) wherein an end surface thereof is polygonal, and the cylindrical blocks are provided with a radio-wave reflecting surface arranged in such a manner that this surface is perpendicular to the axial direction of the blocks, and the end surface of the blocks is approximately perpendicular to a direction from which radio waves are incident. The ferrite magnetic material could also be formed into rectangular prisms of thickness $2t_m$, height d, and length in the longitudinal direction thereof L, with the prisms aligned at a spacing b on a radio-wave reflecting surface, the direction of the height dimension of the prisms being approximately parallel to a radio-wave incidence direction, and the surfaces thereof of the dimensions $2t_m$ and L being perpendicular to the radio-wave incidence direction, forming a plane parallel to a magnetic field direction of incident radio waves and the dimension L, wherein the following relationships hold:

$$L \geqq d \geqq 2t_m$$

$$20t_m \geqq b \geqq 2t_m$$

The reasons why it was considered that the present invention would broaden the bandwidth of the wave absorber are described below.

In the configuration of FIG. 1, since a surface with a small surface area is aligned perpendicular to the direction from which incident waves are incident, it can be expected that waves reflected from the interface with the ferrite will be reduced. This differs from the single-layer configuration shown in FIG. 17 in that, in the portions where there is ferrite, the ferrite portions and vacant portions are arranged alternately, then no plane waves can exit - transverse-magnetic (TM) waves are propagated. Therefore the interfaces with the ferrite ensures that the waves that are not propagated into free space, are converted into TM waves, increasing the absorption over a wide frequency range and thus broadening the bandwidth.

In other words, in the conventional wave absorber, a surface of the ferrite tiles with a large surface area is aligned perpendicular to the direction of incident radio waves. The wave absorber of the present invention, however, has the characteristic that the equivalent surface with the large surface area is aligned parallel to the direction of incident radio waves, and the resultant electromagnetic characteristics are dramatically different. To put it another way, if the dimensions of the magnetic tiles are defined as a length L, a height d, and a thickness t (where $L>d>t$), the conventional wave absorber has tiles aligned with L-d surfaces thereof perpendicular to the direction of incident radio waves, but the wave absorber of the present invention, on the other hand, achieves a much broader bandwidth by having tiles aligned with the L-t surfaces thereof perpendicular to the direction of incident radio waves.

EFFECTIVE OF THE PRESENT INVENTION

As described above, by providing a construction consisting of blocks of a ferrite magnetic material shaped to specific dimensions and aligned at a specific spacing, the present invention can provide a broadband wave absorber able to absorb radio waves over a wide frequency range, by reducing wave reflection and by increasing absorption by TM wave.

DESCRIPTION OF THE PREFERRED EMBODIMENTS

The present invention will first be described with reference to the embodiment thereof shown in FIGS. 1(*a*), (*b*), and (*c*); this embodiment will then be analyzed with reference to the model thereof shown in FIGS. 2(*a*) and (*b*); the results of experiments will be described with reference to FIGS. 3 to 9; and finally other embodiments of the present invention will be described with reference to FIGS. 10 to 16.

Figure 1A:
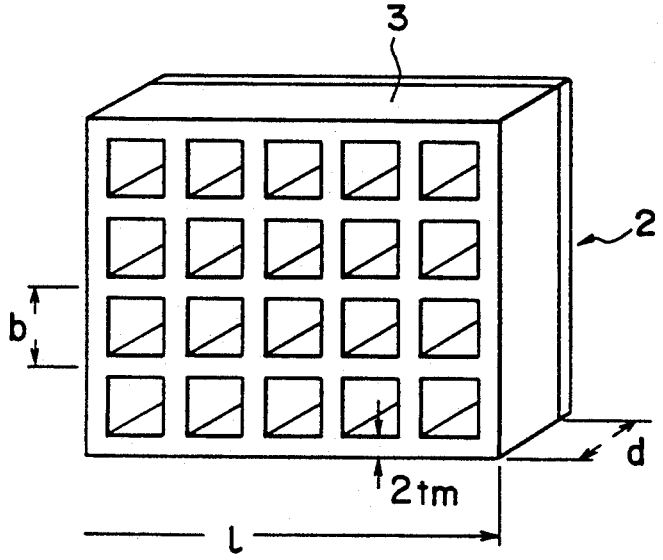
FIGS. 1(*a*), (*b*), and (*c*) are perspective views illustrating an embodiment of the present invention.
Figure 1B:
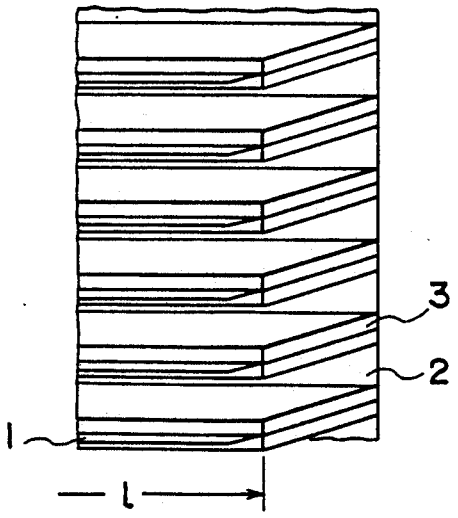
Figure 1C:
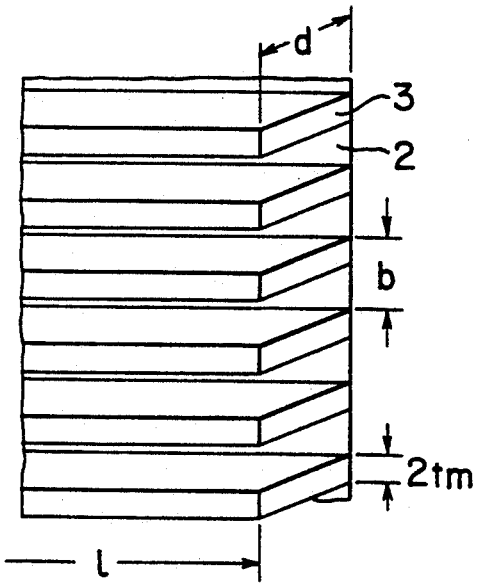

The perspective view of FIG. 1(*a*) shows the essential details of an embodiment of the wave absorber of the present invention that uses horizontally and vertically polarized waves. FIG. 1(*b*) shows a wave absorber similar to that of FIG. 1(*a*), but in which the vertically aligned magnetic frames are removed and a conductive plate that is in contact with the radio-wave reflecting surface is inserted into the thickness of each lateral frame, and FIG. 1(*c*) shows a further example in which the conductive plates are omitted from within the ferrite frames.

The explanation that follows is based on the above structure for unidirectional-polarization waves.

The wave absorber of the present invention is configured of a stack of a large number of identical units of the same construction shown in FIG. 1. Each unit consists of ferrite plates 3 formed in a box shape on a conductive plate 2 that forms a radio-wave reflecting surface, the thickness of the ferrite plates 3 being $2t_m$, the spacing therebetween being b, and the height thereof being d; and the units are aligned on the conductive plate 2 in such a manner as to form a lattice. Since all of these units act in exactly the same manner, analysis thereof can be conducted by considering a single unit.

Figure 2A:
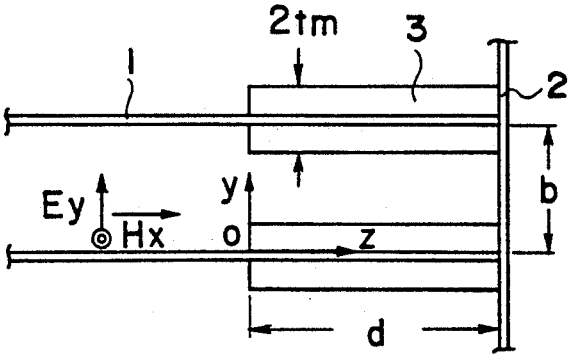
FIGS. 2(*a*) and (*b*) are views of models used in a description of the embodiment of FIG. 1.
Figure 2B:
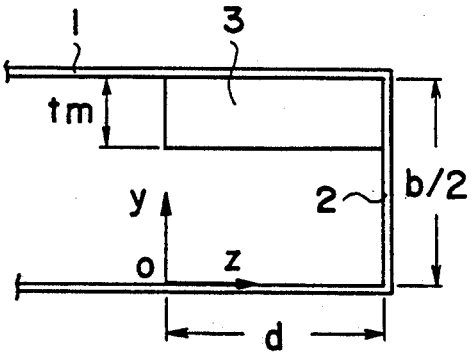

FIG. 2(*a*) shows a single-cell model used in such analysis. The symmetry of the overall structure means that it is possible to assume that a metal plate can be inserted into the central portion of each ferrite plate, parallel thereto, without affecting in any way the magnetic field thereof. Therefore, the analysis below uses the model shown in FIG. 2(*b*).

In this analysis, the following equation is used to find $\mu_r$, the relative permeability of each ferrite magnetic material:

$$\mu_r = 1 + [K_1 \times f_1/(f_1 + jf)]$$

where f is frequency MHz and $(1+k_1)$ ) is the initial relative permeability under DC conditions.

In this equation, f1 [MHz] corresponds to the frequency at which the imaginary part of the relative permeability becomes a maximum.

A value S, the product of k1 and f1 (i.e., k1×f1), is the quality of ferrite magnetic materials. Of the various compositions of ferrite is 10,000 Hz or less.

This analysis uses a value of 6000 MHz for the product S for ferrite. Therefore, if the value of k1 is fixed, the value of f1 [MHz] is automatically fixed.

This analysis is based on the use of ferrite whose value of k1 is 1000 and f1 is 6 MHz.

Since there is virtually no frequency dispersion in the permittivity $\epsilon_r$ of ferrite, so this analysis is based on the assumption that there is no variation therein with the frequency, i.e., that:

$$\epsilon_r = 16 - j0$$

It is known that, with a single-layer absorber using ferrite, the thickness that gives the best absorption is more-or-less constant, regardless of frequency, and that it is 8 mm if S is 6000 MHz.

Figure 3:
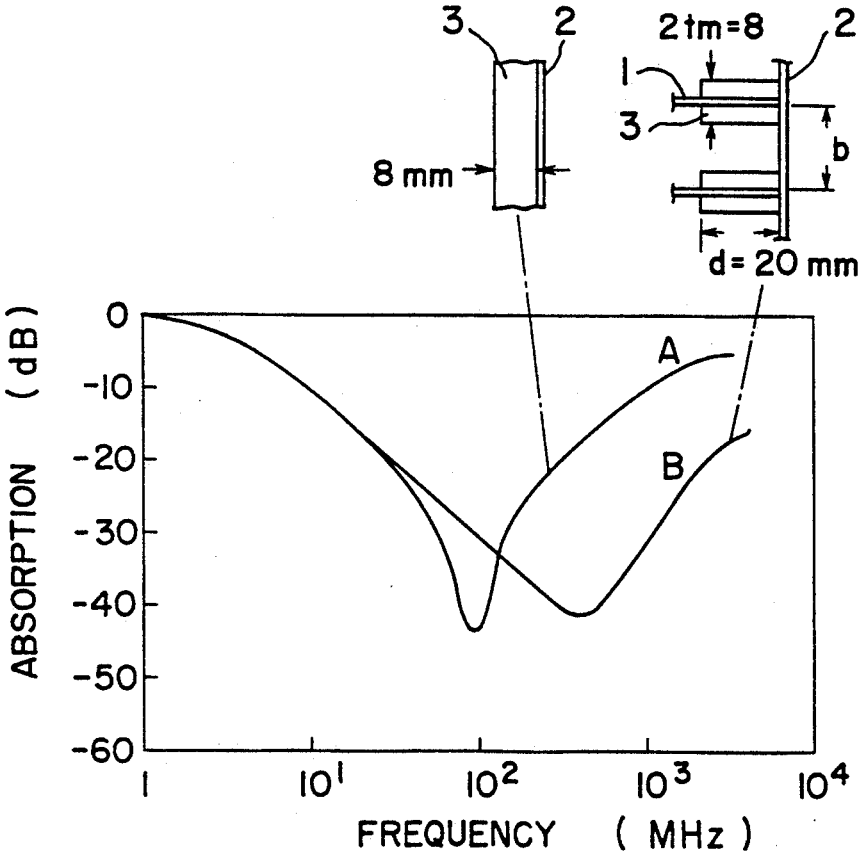
FIG. 3 is a graph of the absorption characteristics of the embodiment of FIG. 1.

In FIG. 3, curve A shows the absorption frequency characteristics for a single-layer absorber.

The wave absorber of the present invention has three parameters: the thickness $2t_m$ of the ferrite plates, the spacing b between the ferrite plates, and the height d of the ferrite plates. Since it is not feasible to analyze all variations in these parameters, the description below relates to parameters at which the characteristics were best within the analyzed range: $2t_m = 8$ mm, b=20 mm, and d=20 mm. In FIG. 3, the absorption characteristic B for a wave absorber for which the above dimensions were selected is shown superimposed on the characteristic A of the conventional single-layer absorber.

In general, the reflectivity that is a characteristic of a wave absorber must be less than or equal to a permissible reflection coefficient. This analysis concerns evaluation at a frequency bandwidth that is 1% of the power level, i.e., at −20 dB or less.

It is clear from the characteristics curves of FIG. 3 that the wave absorber of the present invention has an extremely broad bandwidth.

It is also clear that if a wave absorber of this structure is formed with absorbent bodies of the same surface area as that of the single-layer absorber, roughly the same volume of ferrite as that of the single-layer absorber would be sufficient, proving that adoption of the structure of the present invention will result in a dramatic improvement in characteristics for the same quantity of ferrite.

As mentioned above, the absorber of the present invention has three parameters: the thickness $2t_m$ of the ferrite plates, the spacing b between the ferrite plates, and the height d of the ferrite plates. Another parameter is $(b-2t_m)/b$, the proportion of the metal plate occupied by the empty portions between ferrite plates, hereinafter called the vacancy ratio.

Figure 4:
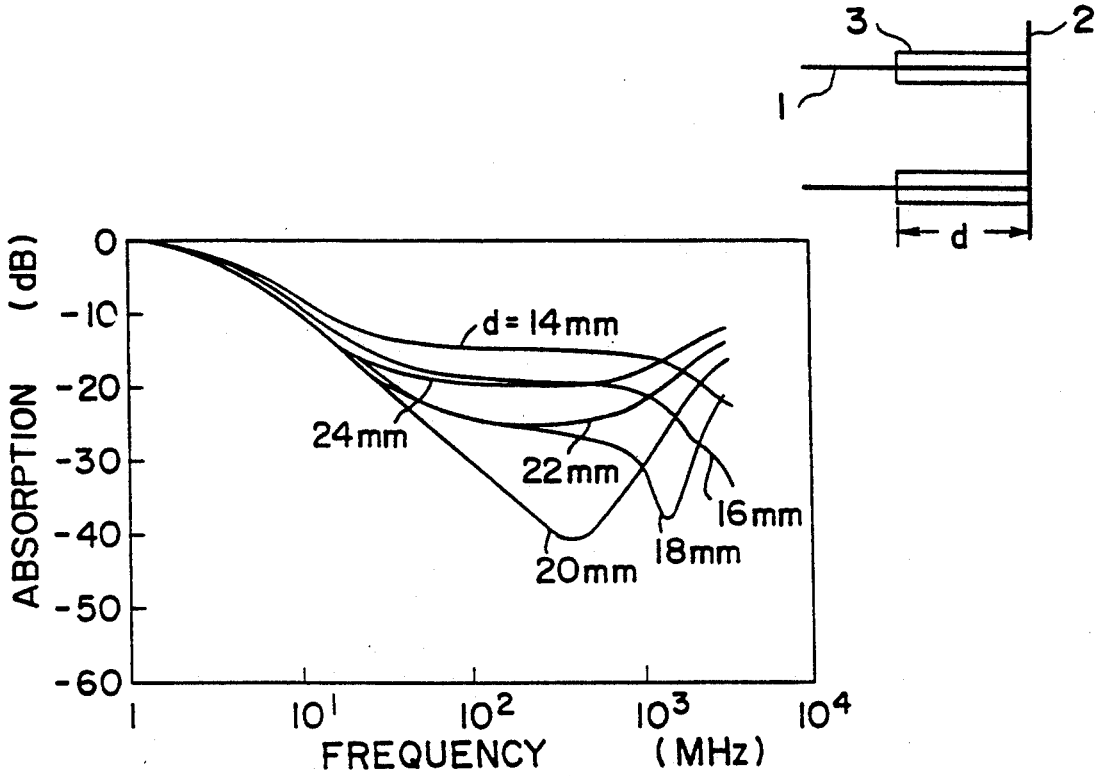
FIG. 4 is a graph of the variation with height of the absorption characteristics of this embodiment of the present invention.

FIG. 4 shows absorption frequency characteristics obtained by varying the height of the ferrite plates while keeping the thickness thereof constant at 8 mm and the spacing therebetween constant at 20 mm. It is clear from the curves of FIG. 4 that when the height d of the ferrite plates becomes less than 20 mm, the characteristic at higher frequencies becomes better, but, in contrast, the characteristic at lower frequencies worsens. Therefore, in this case, it is considered that the best characteristic occurs when the height d is 20 mm.

Figure 5:
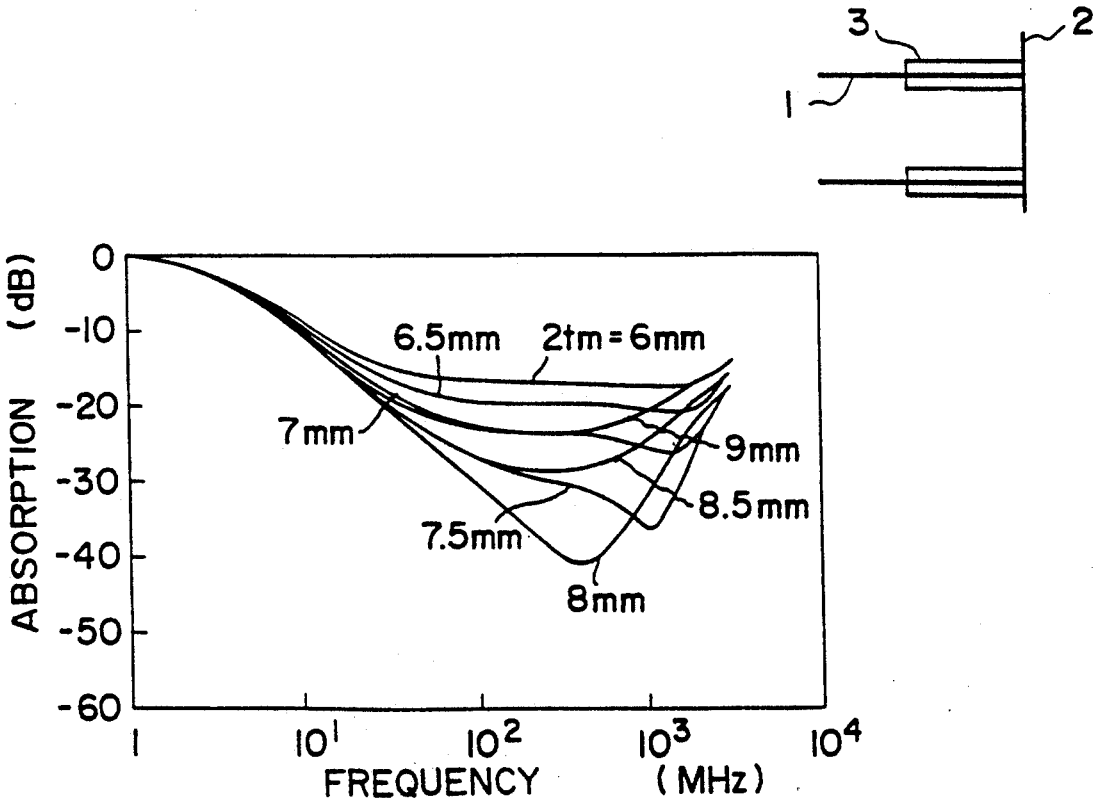
FIG. 5 is a graph of the variation with thickness of the absorption characteristics of this embodiment of the present invention.
Figure 6:
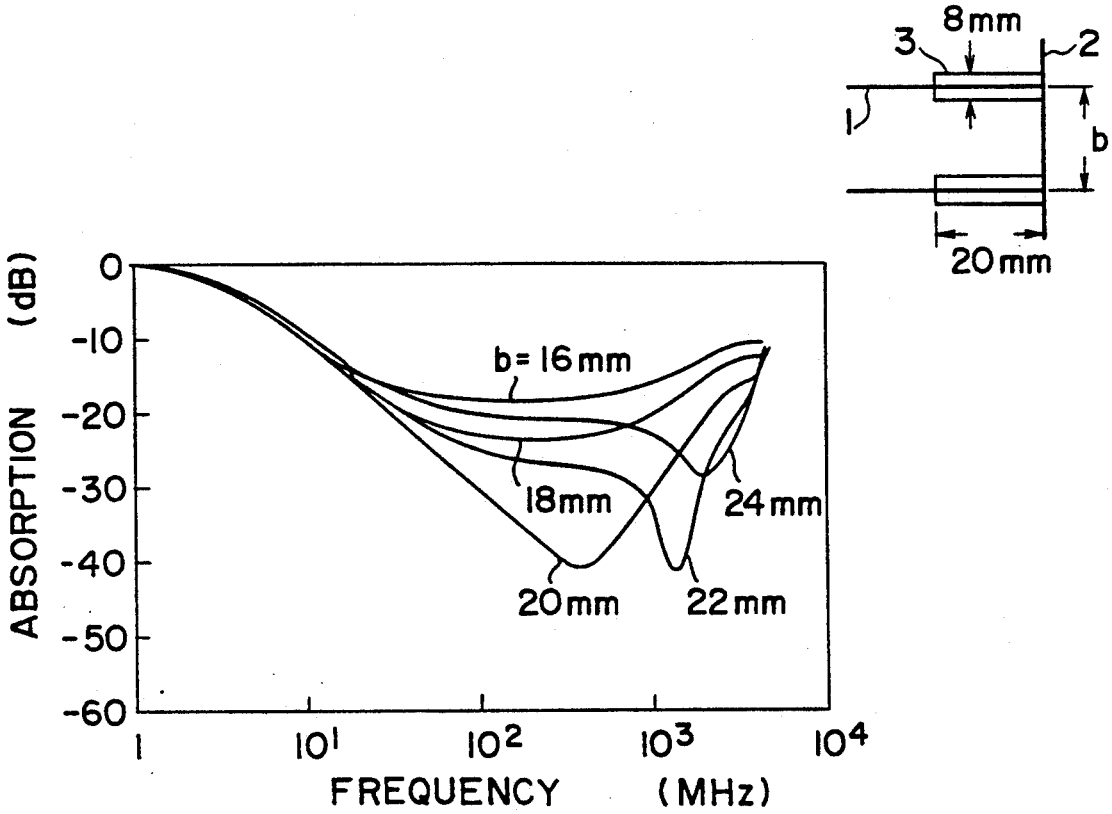
FIG. 6 is a graph of a variation in the spacing of the absorption characteristics of this embodiment of the present invention.

In a similar way, FIG. 5 shows absorption frequency characteristics obtained by varying the thickness of the ferrite plates, and FIG. 6 shows absorption frequency characteristics obtained by varying the spacing therebetween. In both cases, it was found that an optimal value existed, in roughly the same way as that described above for variations in thickness, and this optimal value was at b=20 mm.

Figure 7:
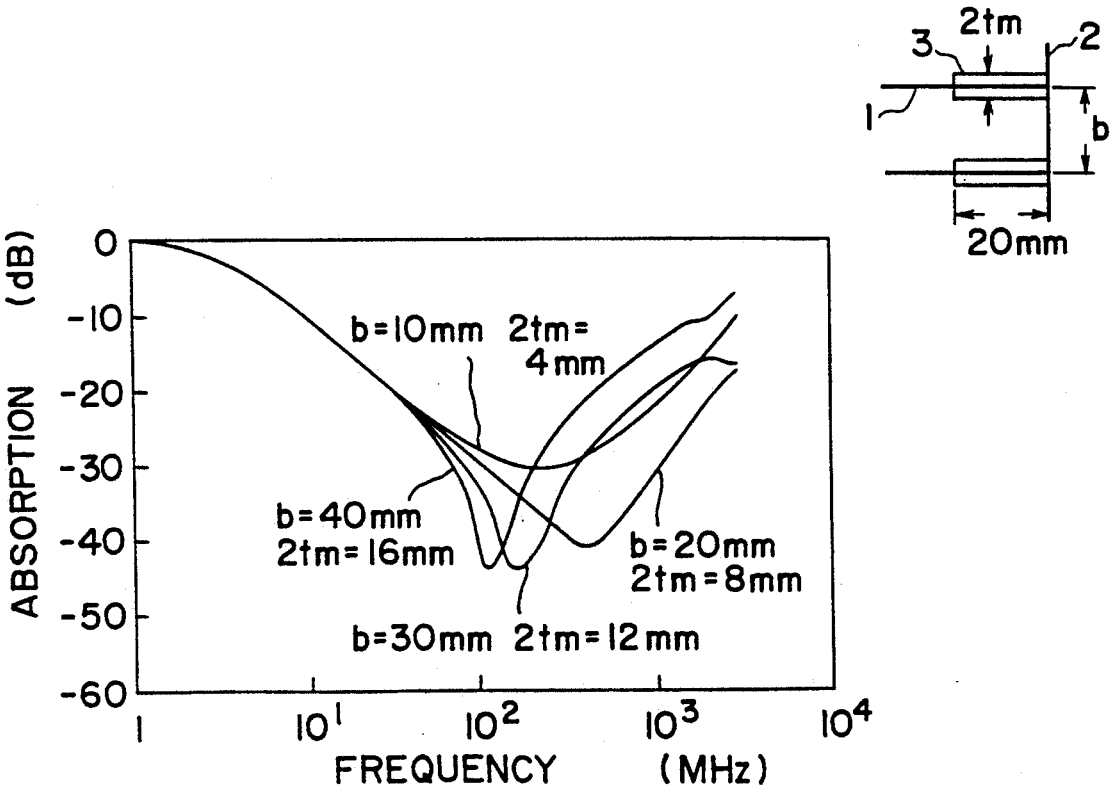
FIG. 7 is a graph of absorption capability, showing the relationship between absorbent bodies and vacant portions used in the present invention.

FIG. 7 shows absorption frequency characteristics obtained by keeping the thickness of the ferrite plates fixed at 20 mm, but varying both b and $2t_m$ in such a manner that the vacancy ratio $(b-2t_m)/b$ was constant at 60%.

The sample characteristics shown in the figure were obtained with b=10 mm, $2t_m=4$ mm; b=20 mm, $2t_m=8$ mm; b=30 mm, $2t_m=12$ mm; and b=40 mm, $2t_m=16$ mm. It is clear that the best characteristic occurs when b=20 mm and $2t_m=8$ mm, showing that the vacancy ratio is not particularly meaningful as a parameter. In other words, with the vacancy ratio kept constant, variations in b and $2t_m$ are far more important as effects on characteristics.

Now for a look at the absorption frequency characteristics obtained by varying the k1 and f1 [MHz].

Figure 8:
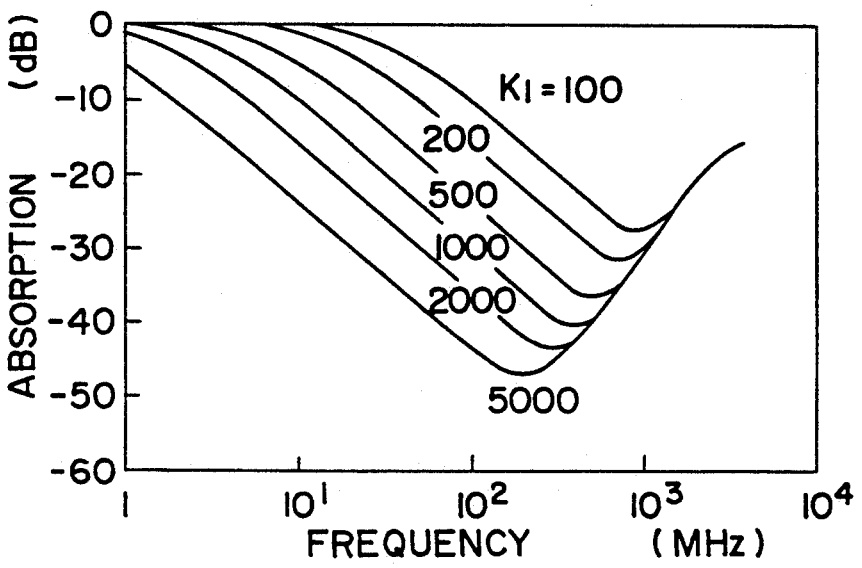
FIG. 8 is a graph of absorption capability, showing the relationship between frequency and the K constants of the dispersion equation used in the present invention.

FIG. 8 shows the characteristics obtained by using the above optimal structure at which the product S is fixed at 6000 MHz, but k1 and f1 [MHz] are varied.

As can be seen from the characteristics curves of FIG. 8, if the value of k1 is increased while the product S is kept constant, the bandwidth broadens. In other words, the frequency at which the curve starts to fall below −20 dB is determined by $K_1$, whereas the frequency at which the curve starts to rise above −20 dB is determined by the configuration of the absorber.

Next is an investigation of the case in which the product S is varied.

Figure 9:
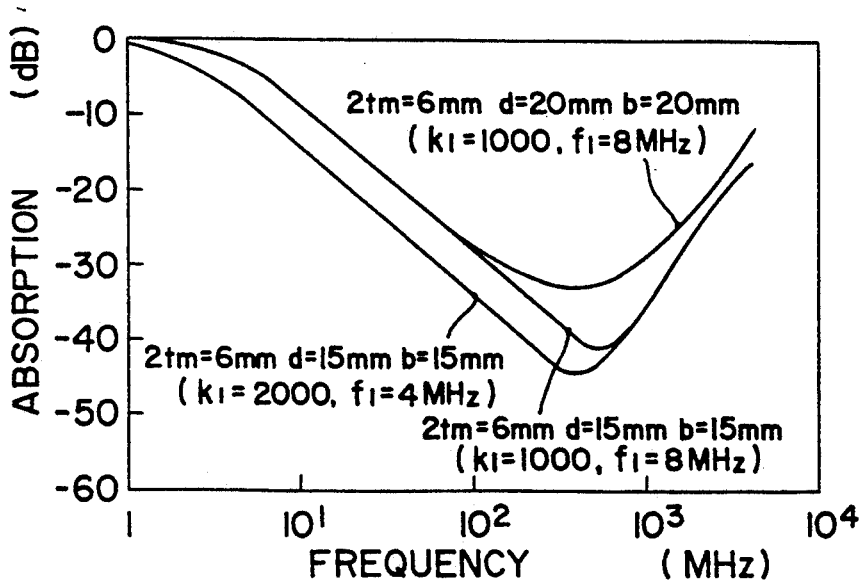
FIG. 9 is a graph of absorption characteristics when the product S of the k1 and f1 [MHz] of the dispersion equation is 8000 MHz.

FIG. 9 shows the absorption frequency characteristics obtained when the product S was 8000 MHz.

With S=6000 MHz, the best characteristic was obtained when $2t_m=8$ mm, b=20 mm, and d=20 mm, but with S=8000 MHz, the best characteristic was obtained when $2t_m=6$ mm, b=15 mm, and d=15 mm. Experiments with S=8000 MHz produced the same result that the bandwidth was seen to broaden as k1 increased.

In this way, although it is obvious that dimensions will vary with the permeability and frequency characteristics of the ferrite material used in the optimal structure according to the present invention, in most cases, if the product S of k1 and f1 is between 4000 MHz and 10,000 MHz, $2t_m$ should be between approximately 3 mm and 12 mm, and b should be equal to d, with both being between approximately 12 mm and 30 mm.

Another embodiment of the present invention, based on exactly the same physical phenomenon as the above model but with a different structure consisting of coaxial conductive tubes, will now be described with reference to FIG. 10.

Figure 10A:
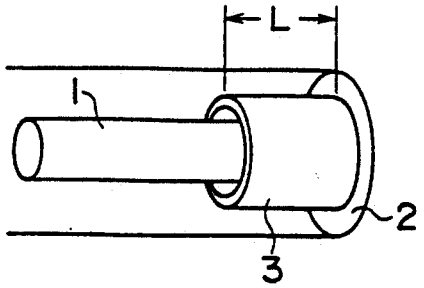
FIGS. 10(*a*), (*b*), and (*c*) are perspective and front views illustrating an embodiment of the present invention configured of coaxial tubes, and a graph showing the characteristic thereof.
Figure 10B:
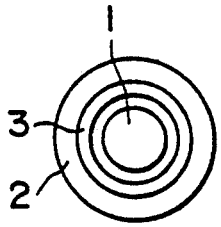
Figure 10C:
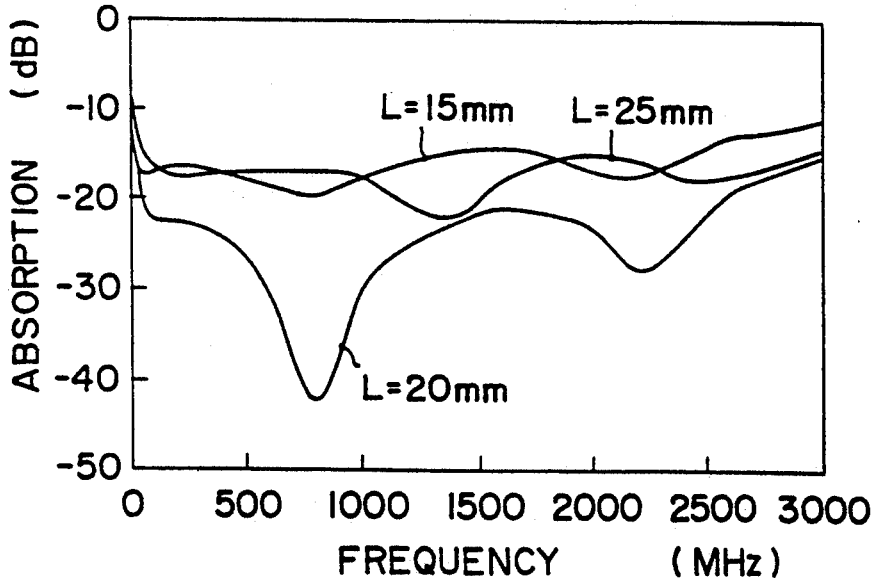

The wave absorber shown in FIGS. 10(*a*) and (*b*) has an annular configuration of an inner diameter of 12 mm, a thickness of 1.5 mm, and a length of 5 mm. This absorber is aligned with a coaxial internal conductor in front in the axial direction f a short-circuiting plate of a circular, coaxial conductive tube. Measurements of the absorption frequency characteristics with respect to variations in length of this wave absorber are shown in FIG. 10(*c*).

As can be seen from FIG. 10(*c*), the bandwidth within which the absorption is below the permissible reflection is much broader at a length of 20 mm, showing good match with analytic results.

Figure 11:
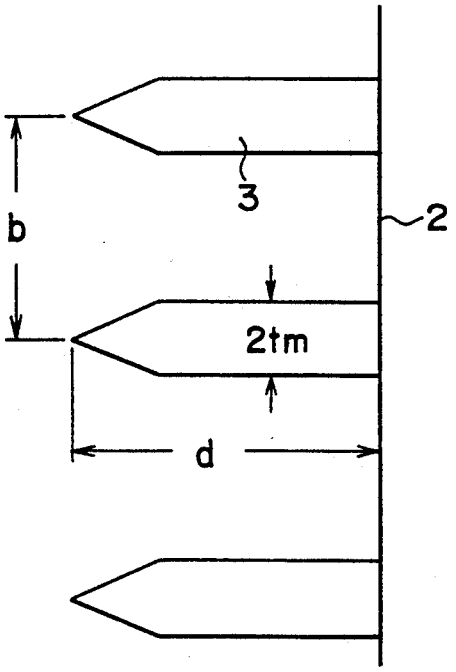
FIGS. 11 to 13 are side and perspective views illustrating other embodiments of the present invention.

Another alternative to the plate-shaped ferrite magnetic bodies of FIG. 1 is a circular or polygonal prismatic form, as shown in FIG. 11.

Figure 12:
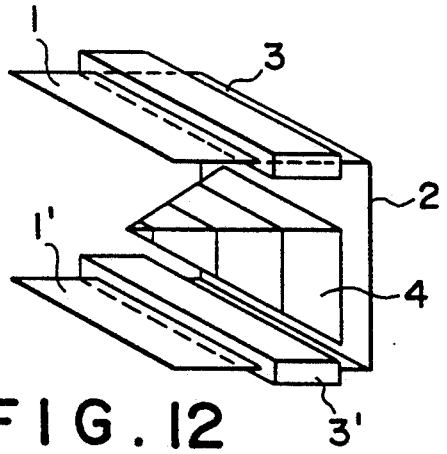

Furthermore, disposing pyramid type wave absorber as shown in FIG. 12 and that operates at frequencies above the upper limit of the wave absorber of the present invention, either to the front or between parallel flat of the present invention enables compounding to further broaden the band.

Figure 13:
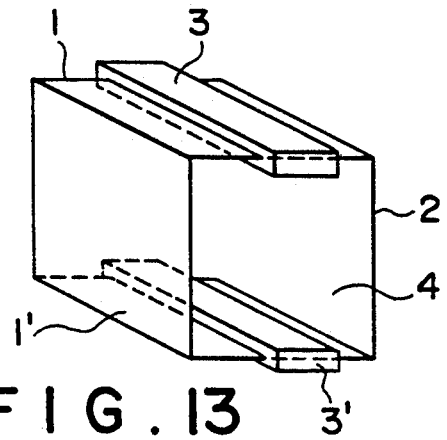

In addition, there was no large change in the characteristics even if there is the dielectric shown in FIG. 13 disposed between the parallel flat plates of the wave absorber of the present invention.

Figure 14:
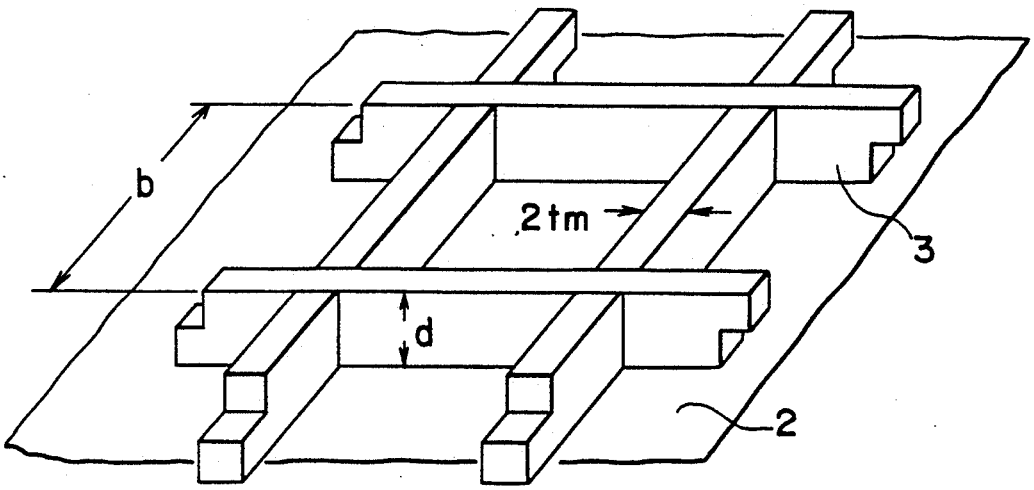
FIG. 14 is a perspective view of an embodiment of the present invention in which ferrite bars are inserted longitudinally and laterally.

FIG. 14 is effective for horizontal and/or vertical polarized waves.

Figure 15:
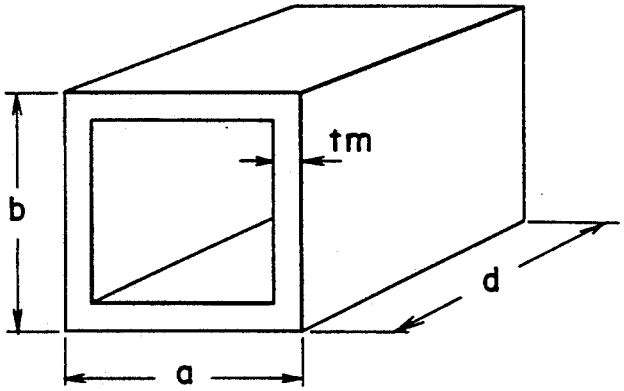
FIGS. 15 and 16 are perspective views of further embodiments of the present invention.

FIG. 15 shows another embodiment of the present invention, in which the shape of the end surfaces of the ferrite magnetic body is formed into a cylindrical shape so that it forms a perpendicular unit. This perpendicular unit uses ferrite having a thickness $t_m$ so that one side is a, and so that the other side is b. This perpendicular unit is formed as a cylindrical block with a height d.

Figure 16:
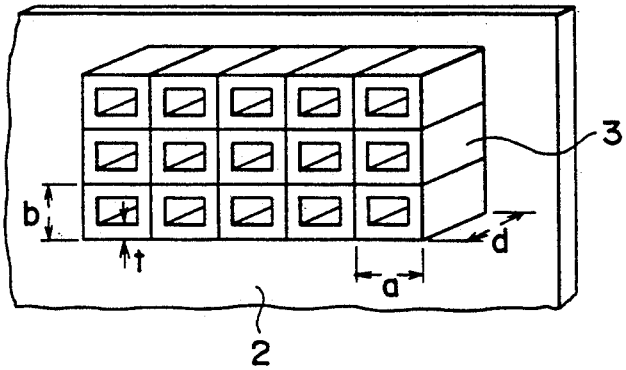
Figure 17:
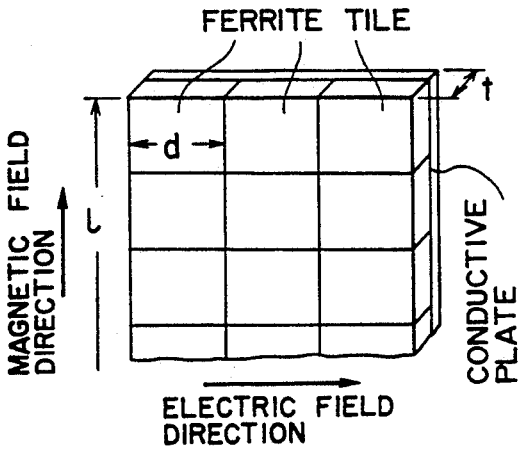
FIG. 17 is a perspective views of the configuration of a wave absorber that has become a conventional standard.
Figure 18:
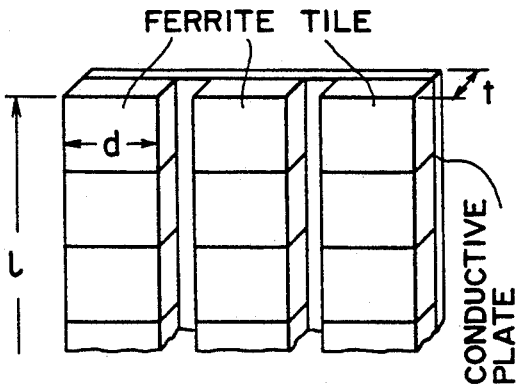
FIG. 18 is a perspective view of the configuration of an actual conventional wave absorber.

FIG. 16 shows one portion of a wave absorber of a required area and in which the cylindrical blocks of FIG. 15 are overlapped in the direction of the one side a, and in the direction of the other side b.

The magnetic material used in the present invention can be ferrite of NiZn, MgZn or MnZn or the like, and moreover, can be materials, such as ferrite powder is mixed with glass, ceramic, rubber, plastic, carbon, paper, or fiber, etc.

What is claimed is:

1. A wave absorber in which a ferrite magnetic material is formed into hollow cylindrical blocks each having a side wall having a thickness $t_m$ and a height d (where $d \geqq t_m$) wherein said cylindrical blocks, having rectangular cross sections, are disposed along a radio-wave reflecting surface aligned in such a manner that said surface is perpendicular to the height direction of said blocks, and said blocks are disposed in side-by-side contacting relationship along the heights of said blocks in a lattice-like array of blocks.

2. A wave absorber having a wave absorber structure according to claim 1 including a member disposed within each of said blocks and projecting therefrom in a direction away from said reflecting surface, said member being an electrically conductive material.

3. A broad-band wave absorber comprising rectangular beams, all of said beams consisting of a ferrite magnetic material and having the same thickness $2t_m$, height d, and length L, said beams having a constant cross-sectional area along the heights thereof, and said beams being aligned at a spacing b on a radio-wave reflecting surface, the direction of the height dimension d of said beams being approximately parallel to a radio-wave incident direction, the space between the beams directly exposing said surface to such incident radiation, and the directions of the thickness $2t_m$ and length L dimensions being perpendicular to said radio-wave incidence direction, wherein the following relationships hold:

$$L \geqq d \geqq 2t_m$$

$$20t_m \geqq b \geqq 2t_m.$$

4. A broad-band ferrite wave absorber having a wave absorber structure according to claim 3, wherein said magnetic material is an NiZn-type ferrite with an initial permeability of at least 700, and said beams have a thickness $2t_m \leqq 8$ mm and a height $d \geqq 20$ mm.

5. A broad-band ferrite wave absorber having a wave absorber structure according to claim 3, wherein said magnetic material is an MnZn-type ferrite with an initial permeability of at least 2000, and said beams have a thickness $2t_m \leqq 8$ mm and a height $d \geqq 35$ mm.

6. A wave absorber having a wave absorber structure according to claim 3, wherein a plate is disposed approximately in the center in the thickness direction of each of said beams of said magnetic material, one edge of said plate being exposed from a direction from which radio waves are incident, whereas the opposite edge thereof is connected to said radio-wave reflecting surface.

7. A wave absorber having a wave absorber structure according to claim 3 including a member disposed within each of said beams and projecting therefrom in a direction away from said reflecting surface, said member being one of an electrically conductive material, a magnetic material, and an electrically resistive material.

8. A wave absorber having a wave absorber structure according to claim 3, wherein said beams are aligned in a lattice form of intersecting beams.

9. A broad-band wave absorber wherein beams formed of a ferrite magnetic material are disposed along a surface of an electrically conductive plate and all of said beams project forwardly of said surface equal distances, said beams being arrayed in a lattice-like form along longitudinal and lateral directions of the lattice, said beams being spaced apart along said directions by a distance b; where $20t_m \geqq b \geqq 2t_m$, and $2t_m$ is a uniform thickness of the beams along the directions of spacing thereof.

10. A wave absorber according to claim 9 including a conductive member disposed within each of said beams.

11. A wave absorber having a wave absorber structure according to claim 9, including a conductive member disposed within each of said beams and projecting forwardly of the front end thereof.

12. A wave absorber having a wave absorber structure according to claim 9 including dielectric members disposed one each between adjacent ones of said beams.

13. A wave absorber having a wave absorber structure according to claim 9, wherein each of said beams extends in at least one of said longitudinal and lateral directions to intersect two beams extending in the other of said directions.

* * * * *